US008096028B2

(12) United States Patent
Bates

(10) Patent No.: US 8,096,028 B2
(45) Date of Patent: Jan. 17, 2012

(54) CASKET ENCLOSURE AND METHODS FOR MAKING AND USING THE SAME

(75) Inventor: Mark Hopkins Bates, Westport, CT (US)

(73) Assignee: The Norwalk Wilbert Vault Company, LLC, Bridgeport, CT (US)

( * ) Notice: Subject to any disclaimer, the term of this patent is extended or adjusted under 35 U.S.C. 154(b) by 47 days.

(21) Appl. No.: 12/543,899

(22) Filed: Aug. 19, 2009

(65) Prior Publication Data

US 2011/0041302 A1 Feb. 24, 2011

(51) Int. Cl.
*A61G 17/00* (2006.01)

(52) U.S. Cl. ..... 27/35; 52/139; 220/324

(58) Field of Classification Search ..... 27/35, 14, 27/17, DIG. 1, 7; 52/134, 139–142; 220/4.33, 220/7, 324; 24/457, 570
See application file for complete search history.

(56) References Cited

U.S. PATENT DOCUMENTS

| | | | | |
|---|---|---|---|---|
| 1,467,862 | A | | 9/1923 | Ledyard et al. |
| 1,791,877 | A | | 2/1931 | Stoker |
| 1,878,781 | A | | 9/1932 | Kettner |
| 2,477,705 | A | * | 8/1949 | Sweet ..... 292/17 |
| 3,435,494 | A | | 4/1969 | Bernard |
| 3,868,799 | A | | 3/1975 | Hayward |
| 4,253,220 | A | | 3/1981 | Work |
| 4,800,631 | A | * | 1/1989 | Pellmann ..... 27/7 |
| 4,922,590 | A | | 5/1990 | Yearsley |
| 5,010,697 | A | | 4/1991 | Schwarten |
| RE33,636 | E | | 7/1991 | Yearsley |
| 5,102,001 | A | * | 4/1992 | Teague et al. ..... 220/324 |
| 5,115,607 | A | | 5/1992 | Pirozzoli et al. |
| 5,123,541 | A | * | 6/1992 | Giannini et al. ..... 206/600 |
| 5,568,677 | A | * | 10/1996 | Tobin ..... 27/17 |
| 5,888,604 | A | | 3/1999 | Evans, Jr. et al. |
| 6,253,503 | B1 | | 7/2001 | Flood |
| 6,269,526 | B1 | | 8/2001 | Bischoff et al. |
| 6,453,626 | B1 | | 9/2002 | Weilein et al. |
| 2008/0301921 | A1 | | 12/2008 | Pirozzoli et al. |

* cited by examiner

*Primary Examiner* — William L. Miller
(74) *Attorney, Agent, or Firm* — Cantor Colburn LLP

(57) ABSTRACT

In one embodiment, an enclosure comprises: a cover comprising a plastic material, a base comprising a plastic material, and a guide configured to engage the cover and the base. The guide comprises a main body, a retaining portion, and a receiving portion. The enclosure is configured to receive a casket with the base under the casket and the cover over the casket. In another embodiment, the enclosure comprises: a cover comprising a plastic material, a base comprising a plastic material, and a guide configured to engage the cover and the base. The guide comprises a main body, a retaining portion, and a receiving portion. The retaining portion further comprises an anchor configured to engage an inner surface of the base if removal of the guide from the base is attempted. The enclosure is configured to receive a casket with the base under the casket and the cover over the casket.

14 Claims, 5 Drawing Sheets

CASKET ENCLOSURE AND METHODS FOR MAKING AND USING THE SAME

BACKGROUND

The embalming process and natural decomposition of human remains results in the generation of viscous fluids. Since caskets are constructed from a plurality of materials, (e.g., wood, metal, and paper materials), the caustic nature of the fluids can lead to corrosion of casket materials. Consequently, caskets are subject to leakage. Since the storage of caskets in mausoleum crypts (e.g., chapel crypts, garden crypts, and so forth), has become more popular in recent years, visual evidence of leakage, as well as odors and pest infestations associated with the fluids, are serious issues frustrating the facile acceptance of such interments. Hence, complete, long term sealing of the caskets within non-degradable enclosures is important to the successful use of mausoleum crypts.

It has been proposed to fabricate a casket enclosure from a single sheet of a thermoplastic resinous sheet material which is shaped into an elongated configuration having open ends that are closed by flat end covers or the like. The casket enclosure is sealed by applying a torch or other heating device around the periphery of the cover to melt the resin and heat seal the junction between the cover and the enclosure walls. Although this type of casket enclosure is simple, easy to assemble, and durable in construction, it is still necessary to hermetically seal the enclosure outside of the crypt chamber since there would be no room left to accommodate a heating device after the enclosure has been loaded into the crypt.

Even though several techniques and enclosures have been developed for use as casket enclosures for mausoleum interments, there continues to be a need for enclosures having a more facile assembly and/or enhanced structural integrity.

BRIEF SUMMARY

Disclosed herein are mausoleum enclosures and methods for making and using the same. In one embodiment the enclosure comprises a cover comprising a plastic material, a base comprising a plastic material, and a guide configured to engage the cover and the base. The cover comprises an upper portion, cover longitudinal walls, and cover end walls extending from the upper portion to a peripheral edge. The base comprises a bottom portion with base longitudinal walls and base end walls extending from the bottom portion to a base peripheral edge. The guide comprises a main body, a retaining portion, and a receiving portion. The retaining portion extends along a length of the body to form a base channel and connects to the main body via a top extension. The base channel has a sufficient width to receive the base peripheral edge. A first lip of the retaining portion is located opposite the top extension and extends away from the main body. The receiving portion extends along a length of the body to form a cover channel and is connected to the main body via a bottom extension. The cover channel has a sufficient width to receive the cover peripheral edge. A receiving lip of the receiving portion is located opposite the bottom extension and extends away from the main body. The enclosure is configured to receive a casket with the base under the casket and the cover over the casket.

In another embodiment, the enclosure comprises a cover comprising a plastic material, wherein the cover comprises an upper portion, cover longitudinal walls, and cover end walls extending from the upper portion to a cover peripheral edge, a base comprising a plastic material, wherein the base comprises a bottom portion with base longitudinal walls and base end walls extending from the bottom portion to a base peripheral edge, and a guide configured to engage the cover and the base. The guide comprises a main body, a retaining portion, and a receiving portion. The retaining portion extends along a length of the body to form a base channel and connects to the main body via a top extension. The base channel has a sufficient width to receive the base peripheral edge. A first lip of the retaining portion is located opposite the top extension and extends away from the main body. The retaining portion further comprises an anchor configured to engage an inner surface of the base if removal of the guide from the base is attempted. The receiving portion extends along a length of the body to form a cover channel and is connected to the main body via a bottom extension. The cover channel has a sufficient width to receive the cover peripheral edge. A receiving lip of the receiving portion is located opposite the bottom extension and extends away from the main body. The enclosure is configured to receive a casket with the base under the casket and the cover over the casket.

In yet another embodiment, the enclosure comprises a cover comprising a plastic material, wherein the cover comprises an upper portion, cover longitudinal walls, and cover end walls extending from the upper portion to a cover peripheral edge, a base comprising a plastic material, wherein the base comprises a bottom portion with base longitudinal walls and base end walls extending from the bottom portion to a base peripheral edge, and a guide configured to engage the cover and the base. The guide comprises a main body, a receiving portion, and a holding portion. The receiving portion is configured to receive the peripheral edge of the cover wherein a bottom extension extends from the main body and connects the receiving portion to the main body. The receiving portion comprises a receiving lip located opposite the bottom extension and extending away from the main body forming a guide into a channel formed by the bottom extension of the receiving portion and the main body. The holding portion is configured to attach to the base and extends along a length of the body wherein a top extension connects the holding portion to the main body. The bottom extension comprises a length greater than or equal to a thickness of the cover peripheral edge. The enclosure is configured to receive a casket with the base under the casket and the cover over the casket.

The above described and other features are exemplified by the following figures and detailed description.

BRIEF DESCRIPTION OF THE DRAWINGS

Refer now to the figures, which are exemplary embodiments, and wherein the like elements are numbered alike.

DETAILED DESCRIPTION

Figure 1:
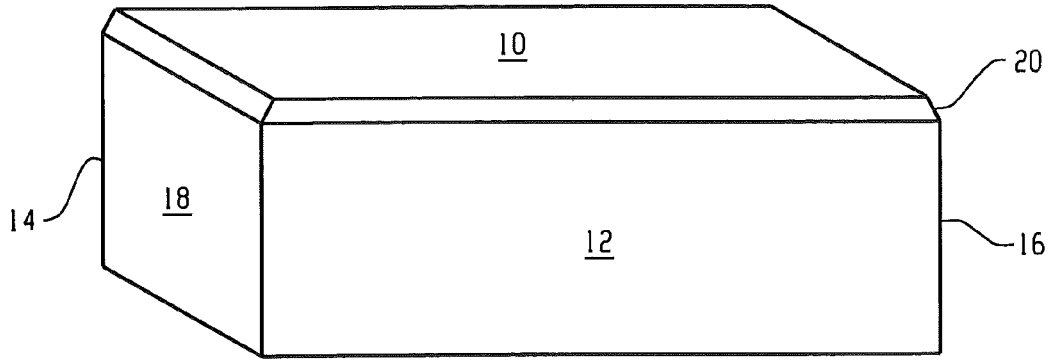
FIG. 1 is a side view of an exemplary enclosure cover.

Disclosed herein is a casket enclosure, e.g., for use in mausoleum interments. Embodiments of the enclosure have enhanced structural integrity, facile assembly, and/or facile handlablity. This enclosure is plastic and can be formed from two unitary elements, namely mateable cover and base portions, with a base portion under the casket and a cover portion over the casket. These portions can be formed from the same or different materials, e.g., plastics. Generally, the plastic(s) will be formed into relatively thin (e.g., about ⅛ inch in thickness) components in order to keep it as lightweight as possible and to allow for easy handling of the enclosure during shipment, storage and entombment in a burial crypt. The plastic is also preferably flexible and pliable so that once the enclosure has been sealed, the enclosure walls can yield to and even bulge to some degree upon the build-up of decomposition gases inside the enclosure, but yet will be strong enough to resist cracking or bursting under relatively high internal pressures.

There are many plastics that are strong and durable enough to employ in the fabrication of a lightweight, sealed, casket enclosure. However, most of these thermoplastic materials are, unfortunately, not chemically resistant to solutions that are employed in the embalming process, notably formaldehyde, and consequently they are not suitable for use in a casket enclosure. Hence, the material employed in forming the casket enclosure (e.g., the base and the cover), is a material that is chemically resistant to the embalming solution(s) employed as well as bodily fluids. Some desirable properties of the resin are set forth in Table 1.

TABLE 1

(Compression Molded Values)

| Property | Value | Test Standard (year) |
|---|---|---|
| Yield Tensile Strength | ≧3,400 lbs/in$^2$ | ASTM D-638 (2004) |
| Tensile Modulus | ≧280,000 lbs/in$^2$ | ASTM D-638 (2004) |
| Impact Strength | ≧1.8 ft · lb/in | ASTM D-256 2004) |
| Flexural Strength | ≧7,000 lbs/in$^2$ | ASTM D-790 |
| Hardness | ≧108 Rockwell R | ASTM D-785 |

lbs/in$^2$ = pounds per square inch
ft · lb/in = foot pounds per inch
≧ = greater than or equal to Plastics that may be useful as the material for the casket enclosure include rubbers, polyesters, polyamides, polysulfones, polystyrenes, and so forth, as well as combinations comprising at least one of the foregoing. Possible plastics include polyalkylenes (e.g., polyethylenes (e.g., high density polyethylene, low density polyethylene), polypropylene, polytetrafluoro ethylene), butyl rubber, acrylonitrile-butadiene-styrene, acrylonitrile-ethylene-styrene (AES), ethylene-propylene-diene-monomer rubber (EPDM), methacrylate-butadiene-styrene (MBS) urethanes, silicones, vinyl esters, polyvinyl chlorides, polystyrenes, polyphenyl sulfones, polyamides, and so forth, as well as combinations comprising at least one of the foregoing. For example, styrenic based composition materials are strong, durable, and chemically resistant to embalming solutions. An exemplary styrenic based composition includes acrylonitrile, butadiene, and styrene, such as the thermoplastic resinous materials produced under the trade name "ABS Resins" commercially available from Dow Chemical Company, Plastics Department, Midland, Mich.

The two portions of the casket enclosure are attached together using chemical and/or mechanical processes, e.g., chemical bonding, thermal welding, and so forth. These processes can also employ mechanical connectors such as latches, snap fit joints (e.g., such as cantilever snap fits, tape and so forth), and other connectors. The chemical process can comprise the use of an adhesive that bonds the components together, and/or the use of a solvent that dissolves a predetermined amount of the interface of one or both of the components, and then solidifies to form a seal (e.g., chemical bond or chemical weld). The specific material used to seal the components together will be dependent upon the specific materials used to form the components, as well as the desired pressure to be placed on the components to attain the seal. A possible adhesive comprises butyl rubber.

Possible solvents include ketones such as methyl ethyl ketone (MEK). For example, for an ABS cover, MEK can be disposed at the interface of the components (e.g., the component peripheral edge at the open end and the channel in which the edge will be located). Once the peripheral edges of the walls are disposed in the guide(s), the MEK will react quite rapidly with the ABS resin to dissolve the same at room or ambient temperatures, taking about 15 minutes to partially solidify or set up to a semi-liquid state and about 24 hours to cure to full strength. It is noted that since the solvent (MEK) is sold commercially as a liquid, it may be desirable to thicken the solvent to the consistency of a semi-liquid or paste by the addition of unreacted resin chips (ABS). Desirably, the paste flows easily throughout the interface under moderate pressure and remains in place without running or spilling and possibly destroying the integrity of the bonded joint after the dissolved resin has been cured.

Figure 2:
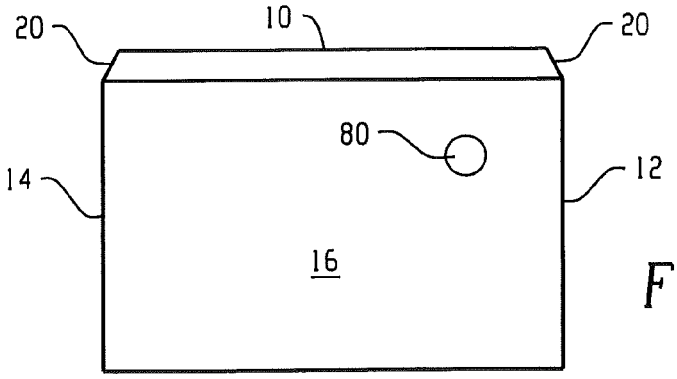
FIG. 2 is an end view of the enclosure cover of FIG. 1.

Referring now to the figures, where one embodiment of an enclosure cover is illustrated in FIGS. 1 and 2. The cover has an upper portion 10 that is integral with longitudinal walls 12, 14 and end walls 16,18. Optionally the longitudinal walls can meet the upper surface at chamfered top edges 20. These edges 20 add strength and rigidity to the structure while eliminating the top corners that might otherwise hinder insertion of the enclosure into the crypt.

The sides 12,14 and ends 16,18 can be sufficiently thin to be flexible and allow attachment to the enclosure base, while having sufficient structural integrity to be self-supporting and stable. It is also noted that different portions of the cover (e.g., longitudinal wall 12, longitudinal wall 14, end wall 16, end wall 18, chamfered top edges 20, and/or upper portion 10) can have different thicknesses that provide the desired structural integrity while enabling facile attachment to the base. The thicknesses are also dependent upon the particular material employed for the cover. The thickness can be about 1.5 millimeters (mm) to about 5 mm, or, more specifically, about 1.5 mm to about 1.6 mm.

Figure 3:
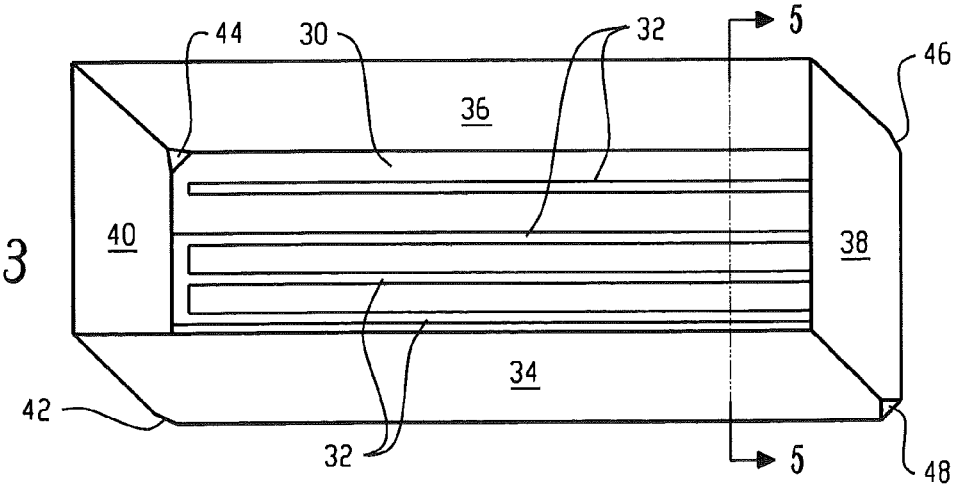
FIG. 3 is a top view of an exemplary enclosure base.
Figure 4:
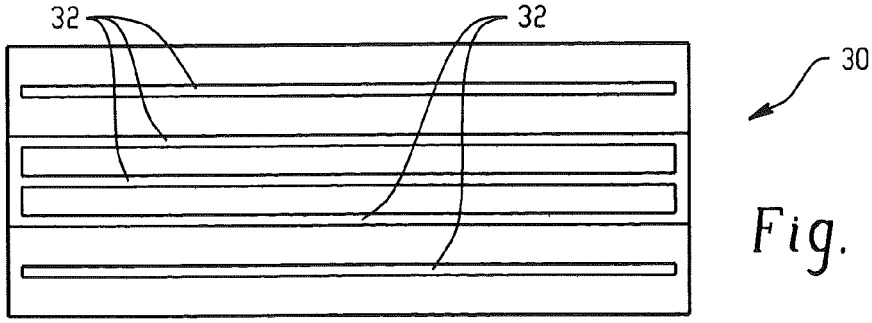
FIG. 4 is a bottom view of the enclosure base of FIG. 3.
Figure 5:
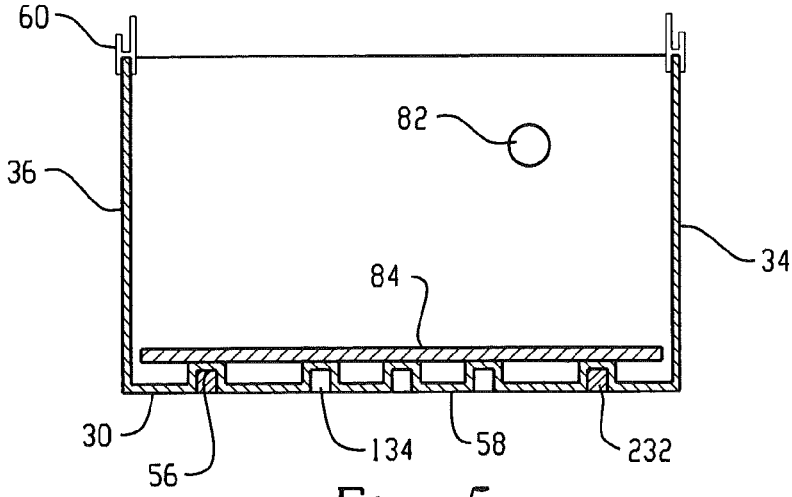
FIG. 5 is cross-sectional view of the enclosure base of FIG. 3 taken along lines 5-5.

Referring to FIGS. 3-5, the base comprises support elements 32 in a bottom portion 30 with longitudinal walls 34,36 and end walls 38,40 extending from the bottom portion 30. At the two intersections of the bottom portion 30 (e.g., bottom surface 30), longitudinal wall 34, and end wall 40, the base can have a chamfered portion 42, e.g., a beveled edge instead of a pointed corner. The chamfered portion eliminates a potential weak point that can be damaged during insertion of the casket enclosure (comprising the casket and remains), into the crypt. The chamfered portion can be located on the base where the base is located under the casket. The chamfered portion can be located in the bottom portion 30 of the base. The chamfered portion can comprise the bottom corner of the enclosure (42,44,46,48), or can extend along all or a portion of the intersection between the end wall 54 and the longitudinal wall 52 (chamfered portion 50 in FIG. 6). Additionally, the chamfered portion can be at one or both ends of the casket enclosure. In one embodiment, the base can be configured to comprise a chamfered portion 50 where the bottom portion 30 and at least one of the base longitudinal end walls 34, 36 meets at least one of the base end walls 38, 40.

The structural integrity of the base can be enhanced with support element(s) 32; protrusion(s) extending into the base forming peaks 56 and valleys 58 (hereinafter ribs). The ribs can extend longitudinally (as illustrated in FIGS. 3 and 4), laterally, and/or otherwise. The support element(s) 32 (e.g., ribs) can be located in the bottom portion 30 of the base. The ribs can be designed and located to allow fluids to be dispersed evenly throughout the base unit. The ribs can also be designed to protect the base unit from fluids, (e.g., by keeping the base unit above any leaking fluid). For example, the base can comprise longitudinal ribs as well as cross ribs that extend from at or near one corner of the base toward a diagonal corner of the base (e.g., from near chamfered portion 42 toward (and optionally to), chamfered portion 46). In some embodiments, ribs forming an "X" configuration on the bottom portion 30 can be used alone or in combination with ribs that extend parallel to the longitudinal walls 34,36, and/or ribs that extend parallel to the end walls 38,40. In an exemplary embodiment, the ribs can extend longitudinally (i.e., substantially parallel) with the longitudinal end walls 34, 36.

As is shown in FIGS. 5, 6, 9, and 10, some or all of the ribs can be hollow 132,134 or reinforced 232. Reinforced ribs 232 can comprise a support material (e.g., foam, metal, plywood, plastic/wood composite), and/or a support element that is installed at the manufacturing facility. The support element can be hollow, solid, or filled, and optionally reinforced (e.g., a solid bar (of any appropriate, compatible cross-sectional geometry), a hollow bar (e.g., a tube or conduit), a filled bar (e.g., filled with a structural foam), and so forth, wherein any of the forgoing can be fiber reinforced). The number and location of hollow and filled rib(s) is based upon attaining the desired structural integrity and can be adjusted for different casket requirements (e.g., the weight of the particular remains to be housed in the casket). Possible foams include polymer foams such as polyurethanes, polystyrenes, and polyethylenes, as well as combinations comprising at least one of the foregoing materials.

The hollow ribs 134 can be partially enclosed (e.g., have a lip or ridge (see FIGS. 6 and 10)) or wholly enclosed (have a fourth wall (see FIG. 8)) and open at one or both ends of the ribs. These ribs 134 can have a geometry (e.g., in the form of a tube, conduit, 3 sided channel with ridge(s), and so forth) and size capable of receiving additional support material such as a support element described above. In this embodiment, the customer can install additional support into the base as needed for the particular application (e.g., a particularly heavy casket, etc.). These hollow ribs 134 are configured to subsequently receive the support material, such as remotely at a customer site, after the base has been completely fabricated. Optionally, these ribs can be designed such that the support element is removably installed into the base (e.g., slidably installed, snapped into the base, and so forth).

Figure 6:
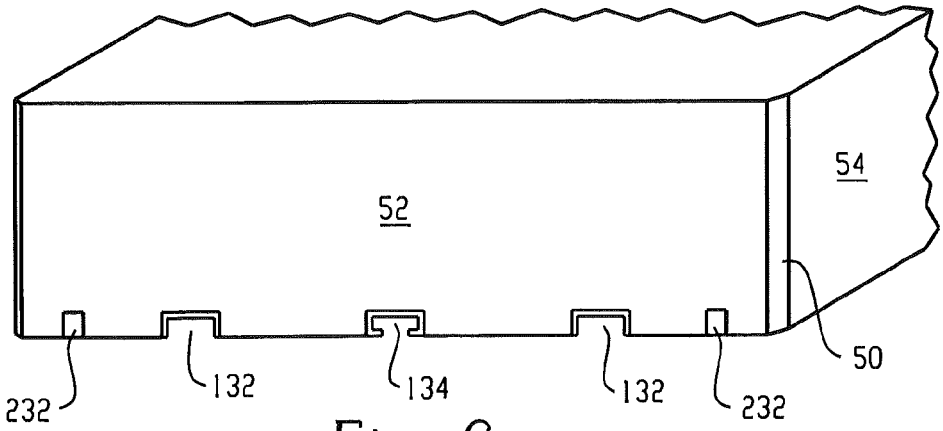
FIG. 6 is a partial side view of an exemplary enclosure base.
Figure 10:
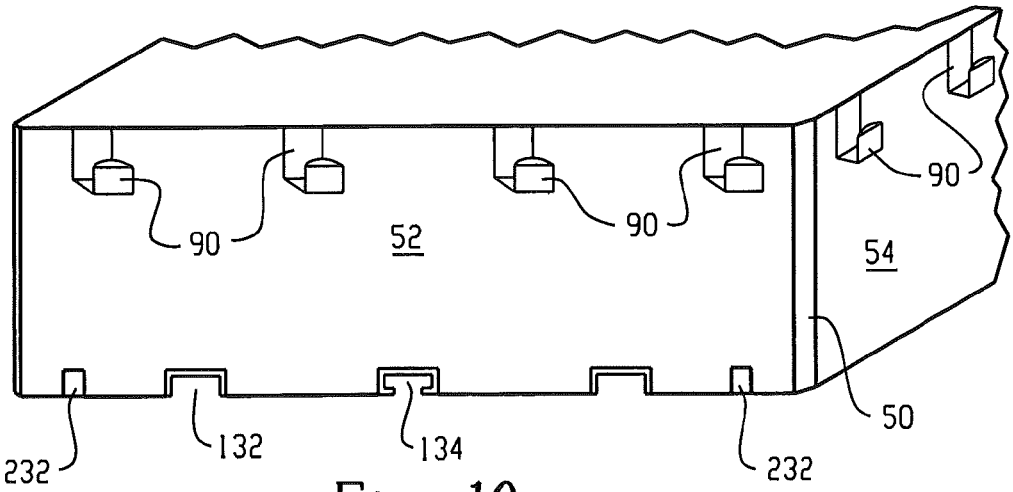
FIG. 10 is a partial side view of an exemplary enclosure base.

As is illustrated in FIGS. 6 and 10, some ribs can have a size and geometry to enable the enclosure to readily be picked up once assembled. For example, ribs 132 can be sized to receive lifting straps and/or the like. Meanwhile, one or more additional ribs (e.g., fillable rib(s) 134 with post inserted support material at the customer site; and/or reinforced ribs 132 (support material installed at the manufacturing facility during manufacturing).

Figure 7:
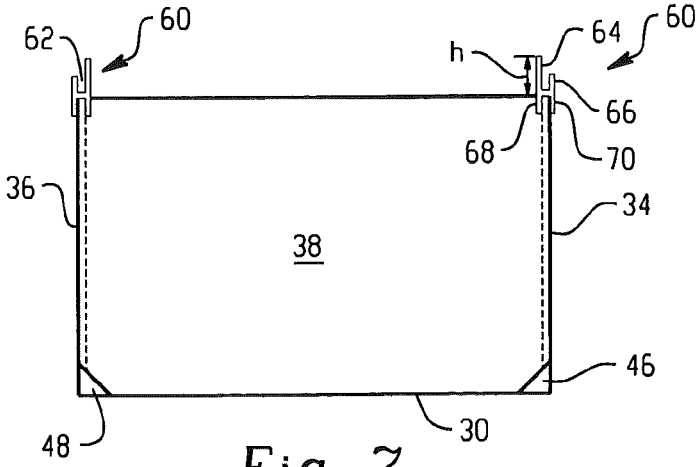
FIG. 7 is an end view of an exemplary enclosure base.
Figure 8:
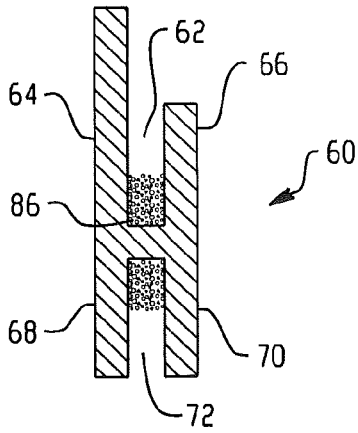
FIG. 8 is a cross-sectional view of one embodiment of a post attachable guide.

Extending from the walls can be guide mechanism(s) that guides the cover and base together (see FIGS. 5, 7, 8, and 9-13). The guide(s) can be located on each wall of the base or the cover, or guides can be located on opposite walls of the base (e.g., the longitudinal walls 34,36), and opposite walls of the cover (e.g., the end walls 16,18). Referring to FIGS. 5, 7, and 8 the guide 60 can be designed and sized to facilitate assembly of the enclosure, e.g., the channel can be disposed around the outer periphery of the base and can be adapted to receive, in an abutting relationship, the peripheral edges of the walls of the cover which surround the open end. The guide(s) can have an aligning portion 64 that assists in directing the wall into the channel 62, and a receiving portion 66. The aligning portion 64 can have a sufficiently greater height "h" than the receiving portion 66 so as to guide the wall into the channel. For example, the receiving portion 66 can have a height that is less than or equal to about 70% of the aligning portion height, or, more specifically, that is less than or equal to about 50% of the aligning portion height. In some embodiments, the receiving portion height can be about 40% to about 70% of the aligning portion height. For example, if the aligning portion 64 has a height of about 2.5 inches (in.), the receiving portion 66 will have a height of less than or equal to about 1.75 in., or, more specifically, less than or equal to about 1.25 inches.

The guide can have a length that is less than or equal to the length of the wall, with one or more guides along a common wall possible, e.g., a single guide can have a length of less than or equal to 100% of the wall length, specifically less than or equal to 80% of the wall length, more specifically, less than or equal to 50% of the wall length, and yet more specifically, less than or equal to 25% of the wall length. For example, in some embodiments, one wall can have 3 guides, each having a length of 25% of the wall length. In another embodiment, multiple guides having a length of less than or equal to 5% of the wall length, more specifically, less than or equal to 2% of the wall length, can be employed (e.g., see guides 90, FIG. 9).

In one embodiment, the guide 60 can be formed integrally with the cover or base (e.g., be a feature that is formed as the component is formed (such as injection molded)). In another embodiment, the guide 60 can be formed separately from the cover and base and then can be subsequently attached thereto. If subsequently attached, the guide 60 can comprise a generally "H" type geometry as is illustrated in FIG. 8. In this embodiment, extensions 68,70 allow the guide 60 to be attached to the cover or base prior to receiving the peripheral edge of the wall in the channel 62. As with the aligning portion 64 and the receiving portion 66, one of the extensions 68 or 70 can be longer to enable the guide 60 to more readily attach to the base or cover.

Figure 9:
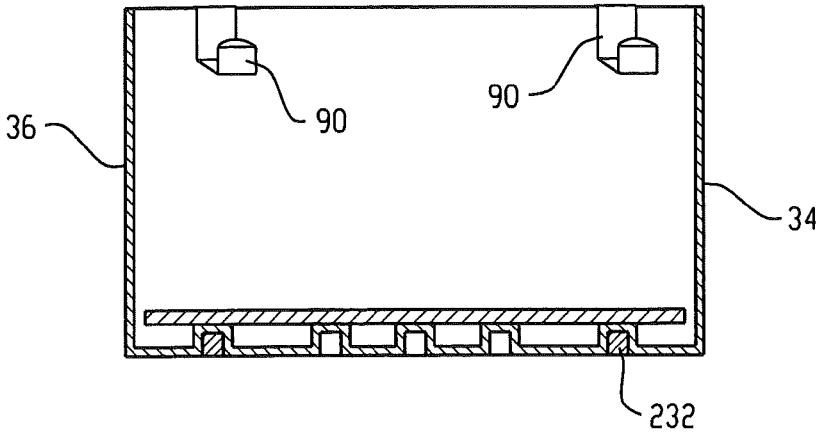
FIG. 9 is a cross-sectional view of the enclosure base of FIG. 3 taken along lines 5-5.
Figure 11:
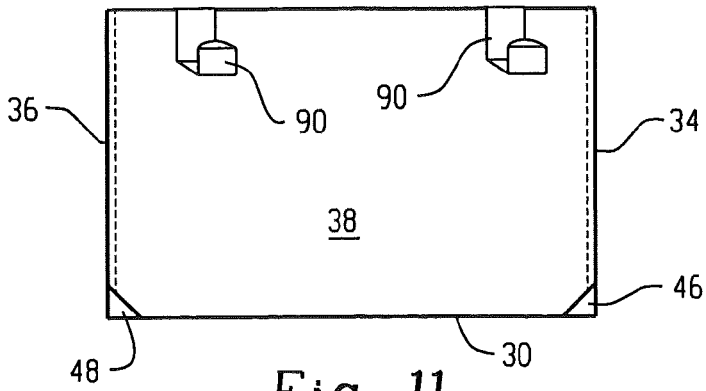
FIG. 11 is an end view of an exemplary enclosure base.
Figure 13:
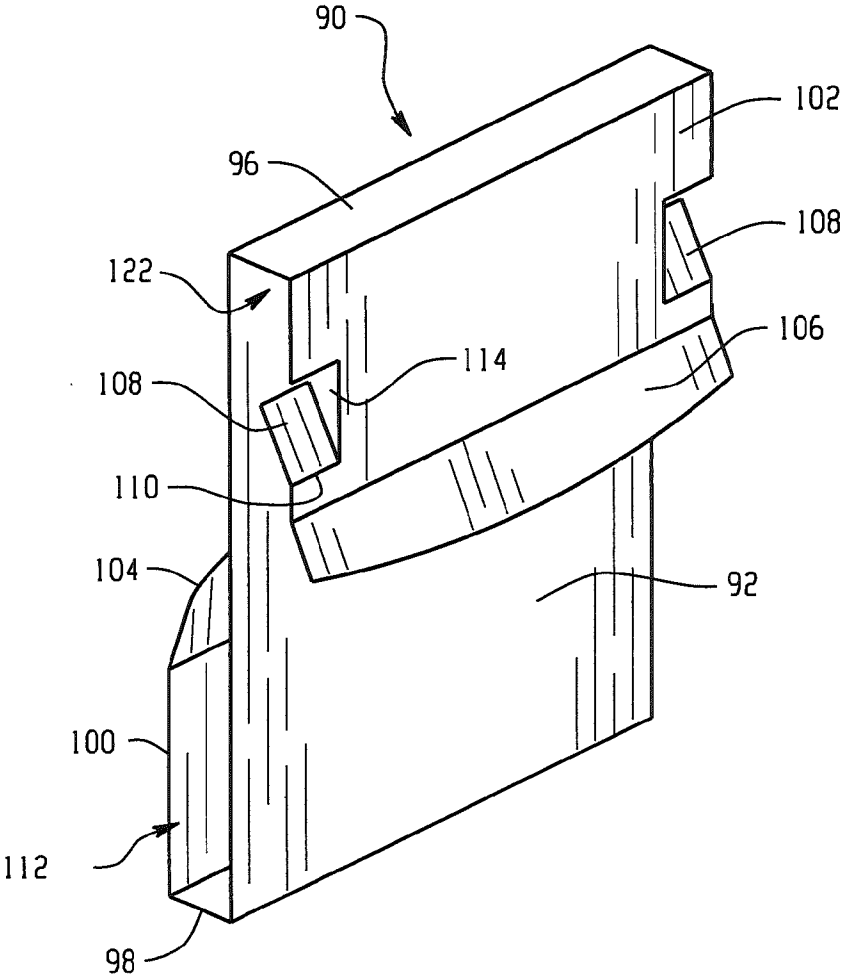
FIG. 13 is a back view of one embodiment of a post attachable guide.
Figure 12:
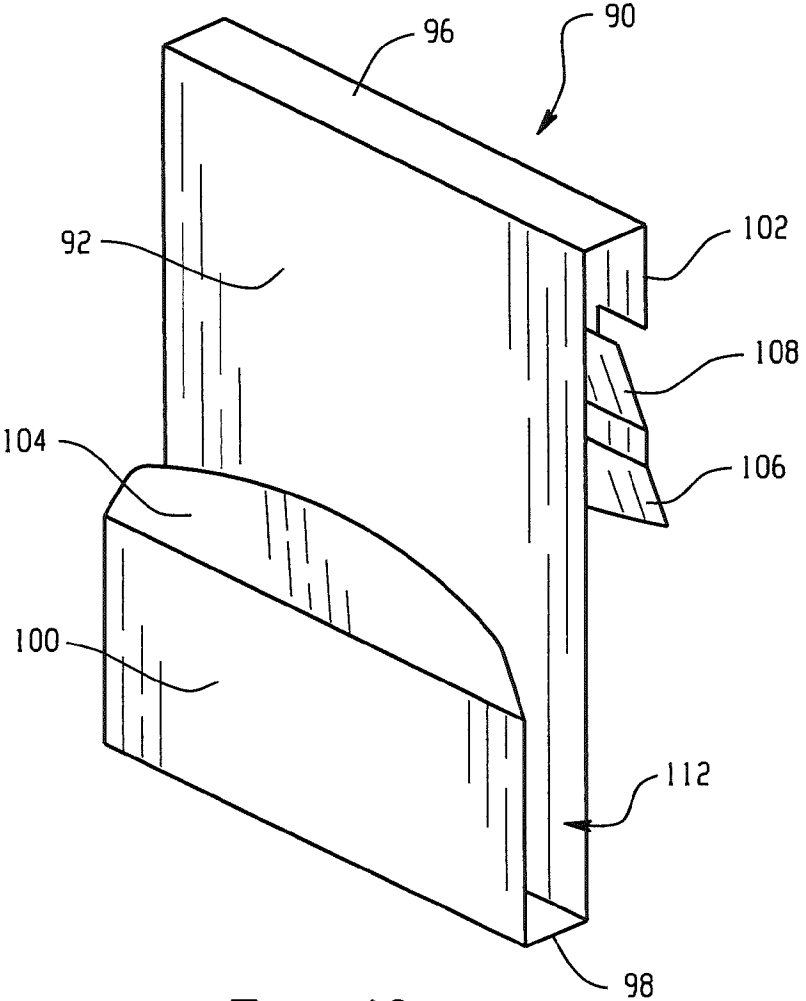
FIG. 12 is a front view of one embodiment of a post attachable guide.

Other embodiments of guides are illustrated in FIG. 9-13. Referring to FIGS. 9, 10, and 11, the guide(s) 90 can be located on one or more walls, e.g., on each wall, of the base. Referring to FIGS. 12 and 13, the guide(s), which can have a generally extended "S" geometry such that the ends of the S hook up and down respectively, can have a main body 92, a top extension 96, and a bottom extension 98. Referring to FIG. 12, the guide(s), also known as guide mechanism(s), can have a receiving portion 100 that is configured to receive the peripheral edge of the cover and a holding portion (also referred to as retaining portion) 102 that is configured to attach to the base. The bottom extension 98 extends from the main body 92 a sufficient distance to enable the edge of the cover to be inserted between the main body 92 and the receiving portion 100. In other words, the bottom extension 98 has a length that is greater than or equal to the thickness of the cover edge. Optionally, the length can be slightly less than the cover edge thickness such that, when the cover edge is inserted into the receiving portion 100, there is a compression engagement that will prevent the cover from separating from the receiving portion; i.e., the cover edge will be compressed between the main body 92 and the receiving portion 100. Extending from an end of the receiving portion 100, opposite the bottom extension 98, is an optional lip 104 that angles outward away from the main body 92 to form a guide into the channel 112. Optionally, the length of the receiving portion 100 along with the lip 104 from the bottom extension 98 can be less than the length of the main body 92. The length should be sufficient to receive and securely retain the edge of the cover.

Desirably, so that the cover will properly engage the base when the edge of the cover is disposed into the channel 112, the distance from the top extension 96 to the bottom extension 98, i.e., the length of the main body 92 is the amount of the desired overlap of the cover over the base. In some embodiments, the main body length is about 2.5 centimeters (cm) to about 12.5 cm.

On the end of the main body 92 opposite the bottom extension 98 and on a side of the main body 92 opposite the receiving portion 100, is the channel 122 formed by the main body 92 and the retaining portion 102. As with the receiving portion 100, the retaining portion 102 extends along a length of the main body 92 to an optional lip 106. (See FIG. 13) The lip 106 angles outward away from the main body 92 to form a guide into the channel 122. Optionally, the length of the retaining portion 102 along with the lip 106 from the top extension 96 can be less than the length of the main body 92. The length should be sufficient to receive and securely retain the edge of the base. The top extension 96 extends from the main body 92 a sufficient distance to enable the edge of the base to be inserted between the main body 92 and the retaining portion 102. Optionally, the length can be slightly less than the base edge thickness such that, when the base edge is inserted into the retaining portion 102, there is a compression engagement that will prevent the base from separating from the retaining portion 102; i.e., the base edge will be compressed between the main body 92 and the retaining portion 102. To further facilitate and maintain the engagement of the guide mechanism 90 with the base, the retaining portion 102 can have anchor(s) 108 that extend from the retaining portion 102 toward the main body 92. The anchor(s) connect to the retaining portion 102 at end 110, and extend toward the main body forming an opening 114 between the end 110 and the top extension 96. This configuration enables the anchors 108 to engage the base so as to inhibit removal of the guide mechanism 90 from the base once installed. If force is applied to remove the guide mechanism 90 from the base, the anchor(s) 108 will engage and in some cases cut into the material of the inner surface of the base, anchoring the guide mechanism 90.

The guide 90, which can be formed integrally with the cover or base or which can be formed separately from the cover and the base and then can be subsequently attached thereto, can comprise any material having sufficient structural integrity and elasticity to be disposed on the base and to receive and hold the cover. Exemplary guide mechanism materials include metals and alloys thereof.

Figure 14:
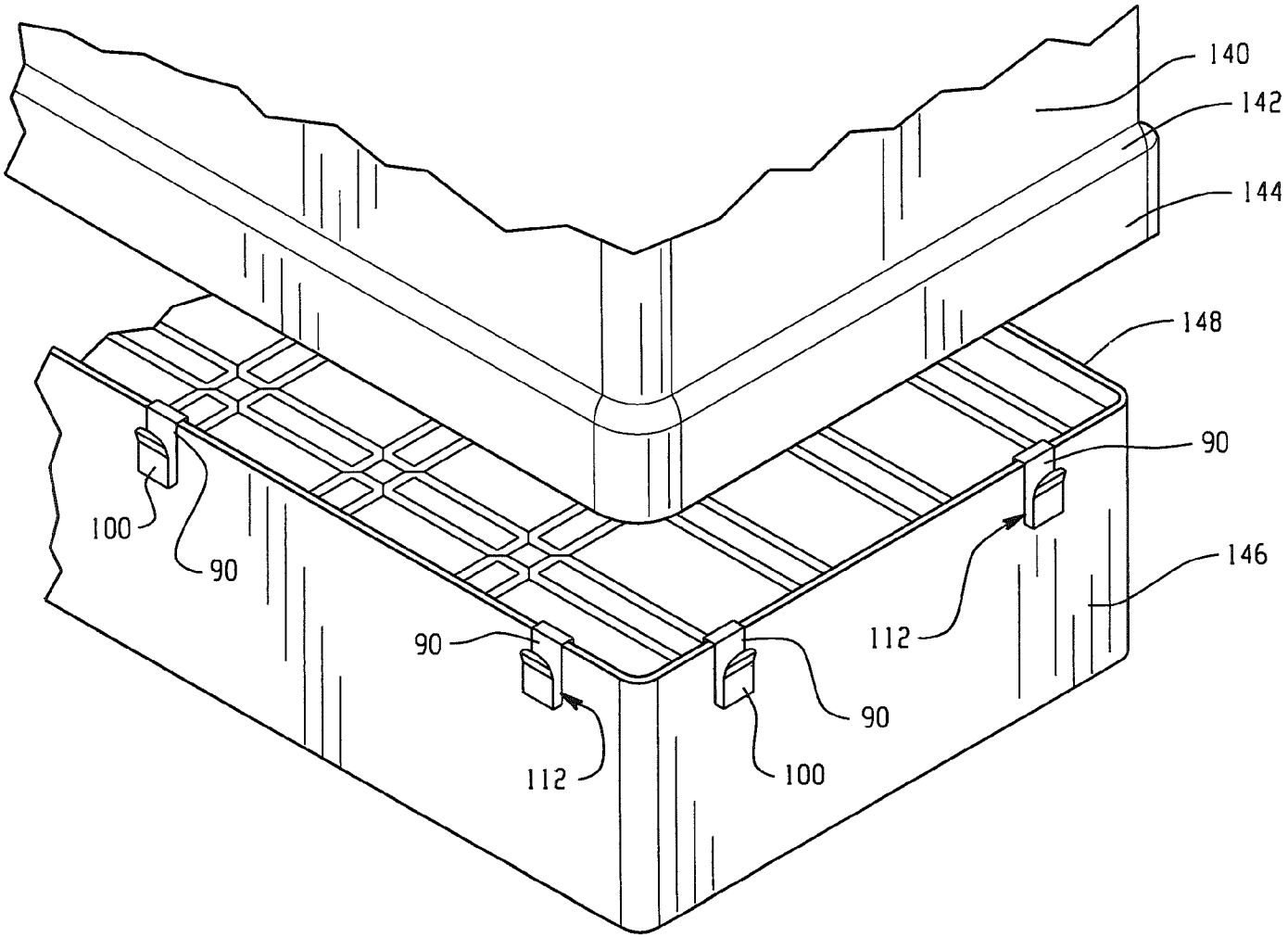
FIG. 14 is a partial, prospective view of an end of an exemplary enclosure base.

Referring to FIG. 14, an exemplary enclosure comprising guides 90 is illustrated. The enclosure comprises a base 146, with guides 90 disposed on the base edge 148 such that the receiving portion 100 is disposed external to the base 146 such that the cover 140 can be disposed into the channel 112. The cover 140 can be formed larger than the base 146 so that when the cover edge is disposed in the channel 112, the cover edge will extend around the outer surface of the base edge 148. Alternatively, or in addition, the cover 140 can comprise a protrusion 142 and an engagement rim 144 configured to be received by the channel 112. The protrusion 142 can have a sufficient length such that the engagement rim 144 can be received by the channel 112.

Optionally used in conjunction with the guide(s) 60, 90, is adhesive. Disposed in the channel 62, 112, and if the guide 60 is not formed integrally with the cover or base, in channel 72, 122, can be an adhesive 86 (e.g., see FIG. 8). As discussed earlier, it is desirable to seal the enclosure to inhibit egress of fluids and/or odors, and to prevent ingress of pests. Therefore, an adhesive capable of sealing the guide 60 to the cover or base (accordingly), is disposed in the channel 62 (or on the peripheral edge of the appropriate component (cover or base)) prior to inserting such component into the channel 62. Clearly, if the guide 60 is post applied to a component, adhesive is placed in channel 72 and/or the appropriate peripheral edge of the component prior to attaching the guide 60. With respect to the guide(s) 90, the adhesive would enhance the engagement of the guide to the cover and/or base.

The adhesive 86 can be disposed in the channel 62, at the customer site (e.g., just prior to the channel 62 receiving the end of the peripheral wall). Alternatively, or in addition, the adhesive 86 can be disposed in the channel 62 prior to delivery to a customer (e.g., at the manufacturing facility). For example, a two component solvent can be separately located in the channel (e.g., one is a paste or solid and the other is a liquid that is contained in a vessel or the two components located in separate vessels) such that the components can be mixed prior to, during, and/or after assembly of the enclosure. The vessels can be, for example, manually punctured prior to assembly of the enclosure to enable mixing of the solvent components, or the insertion of the wall(s) into the channel(s) can puncture the vessel(s) and facilitate the mixing. In other embodiments, the solvent can be in a usable form in a conduit that is breakable on insertion of the wall into the channel. In yet another embodiment, the channel can contain one material (e.g., a paste, or so forth), while another material can be located at the edge of the component to be inserted into the channel (e.g., painted onto the edge, in a recess in the edge, and so forth), such that, when contact between the materials occurs, the desired chemical welding and/or bonding is attained.

As the decomposition process proceeds, fluids (liquids and gases) are released into the casket and eventually into the casket enclosure. Optionally, a sorbent can be located in the bottom portion to absorb the liquids. The sorbent can be a separate mat, granules, sheet, or the like, and/or can be a material applied to the bottom portion. (See sorbent 84 in FIG. 5) The sorbent can be woven, nonwoven, or solid sheet webs comprising natural materials such as cellulose, wool, and so forth, as well as polyolefins, polyesters, nylons, glass, and so forth, and combinations comprising at least one of the forgoing, such as those described in U.S. Pat. No. 5,888,604 to Evans et al.

The production of gases can cause an increase of pressure within the casket enclosure. In order to maintain a pressure balance between the inside of a closed enclosure and the surrounding atmosphere, the enclosure can also comprise a vent. The vent(s) are located in the cover and/or base of the enclosure (herein illustrated as vent 80 in FIG. 2 and vent 82 in FIG. 5). The vent can be a one-way valve (e.g., check valve) that allows the escape of gas once the pressure within the enclosure is sufficiently greater than the pressure outside of the enclosure. For example, at a pressure differential of greater than or equal to about 0.1 pounds per square inch, the valve can release gas to the environment around the enclosure. Desirably the vent prevents the ingress of fluids and/or pests (such as pyroid flies).

Optionally, the enclosure can further comprise a deodorizer to reduce or eliminate odors from the gases released through the vent. The deodorizer can comprise a deodorizing filter located upstream of the vent (80,82) such that vented gases must first pass through the filter, and/or can comprise a substance on the inner surface of the enclosure (e.g., on a portion, or all, of the cover's inner surface).

The present enclosure comprising a cover, base, and guide components, and without separately attachable ends, has improved sealing, and leakage prevention. Simplified sealing is also attained since, without the end pieces, there are fewer seams to bond and/or weld. With the reduction of components, assembly is simplified, especially with the unique guide mechanism. Additionally, with the support elements, the enclosure has enhanced and prolonged structural integrity. The handholds with increased structural integrity allow for ease of handling and transportation—both manually and with mechanical means (i.e., forklift, or hydraulic casket lifting device). The additional pulling plate is designed for ease of movement in and out of the crypt. Also, since the ribs can be designed to receive support material, the casket enclosure is versatile.

Ranges disclosed herein are inclusive and combinable (e.g., ranges of "up to about 25 wt %, or, more specifically, about 5 wt % to about 20 wt %", is inclusive of the endpoints and all inner values of the ranges of "about 5 wt % to about 25 wt %," etc.). "Combination" is inclusive of blends, mixtures, derivatives, alloys, reaction products, and so forth. Furthermore, the terms "first," "second," and so forth, herein do not denote any order, quantity, or importance, but rather are used to distinguish one element from another, and the terms "a" and "an" herein do not denote a limitation of quantity, but rather denote the presence of at least one of the referenced item. The modifier "about" used in connection with a quantity is inclusive of the state value and has the meaning dictated by context, (e.g., includes the degree of error associated with measurement of the particular quantity). The suffix "(s)" as used herein is intended to include both the singular and the plural of the term that it modifies, thereby including one or more of that term (e.g., the colorant(s) includes one or more colorants). Reference throughout the specification to "one embodiment", "another embodiment", "an embodiment", and so forth, means that a particular element (e.g., feature, structure, and/or characteristic) described in connection with the embodiment is included in at least one embodiment described herein, and can or can not be present in other embodiments. In addition, it is to be understood that the described elements can be combined in any suitable manner in the various embodiments.

All cited patents, patent applications, and other references are incorporated herein by reference in their entirety. However, if a term in the present application contradicts or conflicts with a term in the incorporated reference, the term from the present application takes precedence over the conflicting term from the incorporated reference.

While typical embodiments have been set forth for the purpose of illustration, the foregoing descriptions should not be deemed to be a limitation on the scope herein. Accordingly, various modifications, adaptations, and alternatives can occur to one skilled in the art without departing from the spirit and scope herein.

What is claimed is:

1. A casket enclosure, comprising:

a cover comprising a plastic material, wherein the cover comprises an upper portion, cover longitudinal walls, and cover end walls extending from the upper portion to a cover peripheral edge;

a base comprising a plastic material, wherein the base comprises a bottom portion with base longitudinal walls and base end walls extending from the bottom portion to a base peripheral edge, and a guide configured to engage the cover and the base, wherein the guide comprises a main body;

a retaining portion extending along a length of the body to form a base channel and connected to the main body via a top extension, wherein the base channel has a sufficient width to receive the base peripheral edge, and wherein a first lip of the retaining portion is located opposite the top extension and extends away from the main body; and a receiving portion extending along a length of the body to form a cover channel and connected to the main body via a bottom extension, wherein the cover channel has a sufficient width to receive the cover peripheral edge, and wherein a receiving lip of the receiving portion is located opposite the bottom extension and extends away from the main body;

wherein the enclosure is configured to receive a casket with the base under the casket and the cover over the casket.

2. The casket enclosure of claim 1, wherein the guide comprises a S shaped geometry.

3. The casket enclosure of claim 1, wherein the cover peripheral edge is compressed between the main body and the receiving portion to form a compression engagement.

4. The casket enclosure of claim 1, wherein the main body comprises a length of about 2.5 centimeters to about 12.5 centimeters.

5. The casket enclosure of claim 1, wherein the retaining portion further comprises an anchor configured to engage an inner surface of the base if removal of the guide from the base is attempted.

6. The casket enclosure of claim 5, wherein the anchor comprises an opening formed by the anchor extending from the retaining portion toward the main body, wherein the opening is disposed between the top extension and an anchor end that connects the anchor to the retaining portion.

7. The casket enclosure of claim 1, wherein the guide is formed separately from the cover and the base.

8. A casket enclosure, comprising:

a cover comprising a plastic material, wherein the cover comprises an upper portion, cover longitudinal walls, and cover end walls extending from the upper portion to a cover peripheral edge;

a base comprising a plastic material, wherein the base comprises a bottom portion with base longitudinal walls and base end walls extending from the bottom portion to a base peripheral edge, and a guide configured to engage the cover and the base, wherein the guide comprises a main body;

a retaining portion extending along a length of the body to form a base channel and connected to the main body via a top extension, wherein the base channel has a sufficient width to receive the base peripheral edge, and wherein a first lip of the retaining portion is located opposite the top extension and extends away from the main body and wherein the retaining portion further comprises an anchor configured to engage an inner surface of the base if removal of the guide from the base is attempted; and a receiving portion extending along a length of the body to form a cover channel and connected to the main body via a bottom extension, wherein the cover channel has a sufficient width to receive the cover peripheral edge, and wherein a receiving lip of the receiving portion is located opposite the bottom extension and extends away from the main body;

wherein the enclosure is configured to receive a casket with the base under the casket and the cover over the casket.

9. The casket enclosure of claim 8, wherein the anchor comprises an opening formed by the anchor extending from the retaining portion toward the main body, wherein the opening is disposed between the top extension and an anchor end that connects the anchor to the retaining portion.

10. The casket enclosure of claim 8, wherein the guide is formed separately from the cover and the base.

11. A casket enclosure, comprising:

a cover comprising a plastic material, wherein the cover comprises an upper portion, cover longitudinal walls, and cover end walls extending from the upper portion to a cover peripheral edge;

a base comprising a plastic material, wherein the base comprises a bottom portion with base longitudinal walls and base end walls extending from the bottom portion to a base peripheral edge, and a guide configured to engage the cover and the base, wherein the guide comprises a main body;

a receiving portion configured to receive the peripheral edge of the cover wherein a bottom extension extends from the main body and connects the receiving portion to the main body;

a holding portion configured to attach to the base wherein the holding portion extends along a length of the body wherein a top extension connects the holding portion to the main body;

wherein the receiving portion comprises a receiving lip located opposite the bottom extension and wherein the receiving lip extends away from the main body forming a guide into a channel formed by the bottom extension of the receiving portion and the main body; and wherein the bottom extension comprises a length greater than or equal to a thickness of the cover peripheral edge;

wherein the enclosure is configured to receive a casket with the base under the casket and the cover over the casket.

12. The casket enclosure of claim 11, wherein the holding portion further comprises an anchor configured to engage an inner surface of the base if removal of the guide from the base is attempted.

13. The casket enclosure of claim 12, wherein the anchor comprises an opening formed by the anchor extending from the retaining portion toward the main body, wherein the opening is disposed between the top extension and an anchor end that connects the anchor to the holding portion.

14. The casket enclosure of claim 11, wherein the guide is formed separately from the cover and the base.

* * * * *